US006609642B2

(12) United States Patent
Heinz et al.

(10) Patent No.: US 6,609,642 B2
(45) Date of Patent: Aug. 26, 2003

(54) MECHANICAL ADVANTAGE BACKPACK

(75) Inventors: Thomas J. Heinz, Pasadena, CA (US); Edward Bannister, Pasadena, CA (US)

(73) Assignee: Bio Cybernetics International, Pasedena, CA (US)

( * ) Notice: Subject to any disclaimer, the term of this patent is extended or adjusted under 35 U.S.C. 154(b) by 0 days.

(21) Appl. No.: 10/014,786

(22) Filed: Dec. 14, 2001

(65) Prior Publication Data

US 2002/0074373 A1 Jun. 20, 2002

Related U.S. Application Data

(60) Provisional application No. 60/255,390, filed on Dec. 15, 2000.

(51) Int. Cl.[7] ..... A45F 3/04

(52) U.S. Cl. ..... 224/637; 224/628; 224/642; 224/645

(58) Field of Search ..... 224/637, 642, 224/644, 645, 153, 604, 627, 628, 630, 660, 662, 259, 261, 262; 602/19

(56) References Cited

U.S. PATENT DOCUMENTS

| | | | | |
|---|---|---|---|---|
| 232,420 | A | | 9/1880 | Smith |
| 321,146 | A | | 6/1885 | Spencer |
| 571,749 | A | | 11/1896 | Colton |
| 746,563 | A | | 12/1903 | McMahon |
| 787,894 | A | | 4/1905 | Colton |
| 894,066 | A | | 7/1908 | Scarpa |
| 1,469,661 | A | | 10/1923 | Migita |
| 1,530,713 | A | | 3/1925 | Clark |
| 2,036,484 | A | | 4/1936 | Le May |
| 2,100,964 | A | | 11/1937 | Kendrick |
| 2,219,475 | A | | 10/1940 | Flaherty |
| 4,508,110 | A | | 4/1985 | Modglin |
| 5,284,279 | A | * | 2/1994 | Sason et al. ..... 224/632 |
| 5,399,151 | A | | 3/1995 | Smith |
| 5,499,965 | A | | 3/1996 | Sanchez |
| 5,547,461 | A | * | 8/1996 | Levis ..... 128/876 |
| 5,599,287 | A | | 2/1997 | Beczak, Sr. et al. |
| 5,725,139 | A | * | 3/1998 | Smith ..... 224/631 |
| 5,954,250 | A | * | 9/1999 | Hall et al. ..... 224/262 |
| 6,015,076 | A | * | 1/2000 | Pennington ..... 224/637 |
| 6,164,505 | A | * | 12/2000 | Holter et al. ..... 224/259 |
| 6,179,188 | B1 | * | 1/2001 | Gleason ..... 224/641 |
| 6,199,732 | B1 | * | 3/2001 | Swetish ..... 224/262 |
| 6,213,968 | B1 | * | 4/2001 | Heinz et al. ..... 602/19 |

FOREIGN PATENT DOCUMENTS

| | | |
|---|---|---|
| KR | 20-0146563 | 2/1999 |

* cited by examiner

*Primary Examiner*—Stephen K. Cronln
*Assistant Examiner*—Maerena W. Brevard
(74) *Attorney, Agent, or Firm*—Arent Fox Kintner Plotkin & Kahn

(57) ABSTRACT

A pack comprising a pack body, straps, a sleeve attached to the body, and a lumbar sacral support contained in the sleeve and supporting at least a portion of a weight of the pack when secured about a torso of a user and tightened. A frame can be attached to the body having frame members with lower portions and a band around the lower portions. The sleeve can be attached to the band by a pivot pin. The lumbar sacral support can comprise a pair of support body segments, each having an inner end portion and a front end with the front ends detachably connectable to each other; and a mechanical advantage device bridging together the inner end portions to form a belt. The mechanical advantage device include a cable rove around two banks of pulleys which are attached to the front end portions of the support body segments.

13 Claims, 5 Drawing Sheets

MECHANICAL ADVANTAGE BACKPACK

This application claims priority from Provisional Application No. 60/255,390 filed Dec. 15, 2000 which is incorporated in its entirety.

BACKGROUND OF THE INVENTION

A common method of carrying provisions, equipment, and clothing for camping, hiking, trekking, etc. is by the utilization of what is commonly referred to as a backpack. Backpacks come in a variety of styles, however, the five major categories are the Fanny Pack, Day Pack, Built-in Frame Pack, Outside Frame Pack, and Travel Pack.

Although products for each of the five categories of backpacks, and a fanny pack are not expressly discussed herein, the present invention is applicable to all in that the invention can be applied to any of the products mentioned herein as will be apparent to a person of skill in the art, and additional load bearing products in a similar manner.

As a considerable amount of weight is carried on the human body (up to 80 pounds and over), depending on the style of backpack, strain on the body is generally concentrated on the shoulders and spinal column. The load therefore pulls the spine and shoulders back in an unnatural state that can cause discomfort, pain, and even injury. As the shoulder straps of a conventional backpack provide the major anchor to the body for the backpack, the latest technology has made every effort to design the packs to spread the load to the hips to the greatest extent possible.

There are currently two fundamental techniques for achieving the displacement of the load from the shoulders of a user. The first is to utilize a 3–4 inch padded belt around the hips attached to the pack or the frame, to attempt to transfer the load to the hips which can naturally support the load better based on human anatomy. The second technique used by most backpack designers today is to place the shoulder straps horizontal with the shoulders at the top of the pack, in an effort to force the load downward from the highest point of the pack. The result of these efforts has provided modest improvements at best.

Given human anatomy, any load strapped over the shoulders, with gravity pulling that load downward, will place a strain on the major area of contact, mainly, the shoulders. Using a design with straps over the shoulders and a belt to keep the backpack in contact with the hips will provide only a minimum dispersion of this weight to the hips.

The principle of displacing the weight of the load toward a lower and more substantial body part, which can more easily handle said load, is correct. However, the current state of the art in design does not include the most functional method, which is contained in the invention submitted herein.

SUMMARY OF INVENTION

The present invention is designed keeping in mind the previous design hypotheses described above, but adding to that hypotheses, bionics, to achieve what physical human strength cannot.

While it is correct that previous backpack designs that hang over the shoulders and connect to the hips in an attempt to disperse the load of the backpack to the hips, and thereby achieving better support of that load while decreasing stress on the body, the present invention is designed to more effectively accomplish the above. Utilization of a mechanical advantage device (bionics) that can more efficiently and effectively compress the hips and abdominal cavity by circumvention, does at the same time unload the shoulders and spinal column and thereby transfer and spread the load of the backpack to pelvic area of the body. Because of the circumventional compression achieved by this unique device, the amount of the load dispersed is in direct correlation to the amount of abdominal compression achieved. Existing backpack designs all try to accomplish this objective by using a belt that connects the bottom of the backpack to the hips. Most of the time it produces a simple connection of the pack to the body at the area of the hip, but little more. A bionic system herein provides the user a machine that can substitute for the human lack of strength to accomplish the task.

The present invention integrates a mechanical advantage (bionic) lumbar back support into the backpack design in a manner that unloads the shoulders and spine, places the pelvis in a pelvic tilt to strengthen the spinal column, and compresses the abdominal cavity 4–8 times greater than can be achieved without the bionic device, thereby achieving maximum body position and strength to receive the load. The end result is transference of the load 4–8 times more effectively than current backpack designs.

Additional design features addressed herein, that would work in conjunction with the new backpack design, include the use of bionic systems contained herein, to tighten the load inside of the pack, to better conform the width of the pack with the width of the body wearing the pack, thus achieving greater balance of the load on the human body.

Additional design features that could work in conjunction with the new backpack design, include the use of bionic (mechanical advantage) systems contained herein, to tighten the load inside the pack, in order to better conform the pack with the width of the body wearing the pack, thus achieving greater balance of the load on the human body.

Also the need to compress a sleeping bag so as to reduce the size of the sleeping bag in order to best conform it to the balance of the overall load, while making it more compact to fit beneath the pack or in the smallest containment pocket possible, can best be achieved by utilization of a similar bionic (mechanical advantage) system which is easily applied.

BRIEF DESCRIPTION OF DRAWINGS

The drawings below demonstrate the visual content of critical collective parts to the Invention.

DETAILED DESCRIPTION OF PREFERRED EMBODIMENTS OF THE INVENTION

Figure 1:
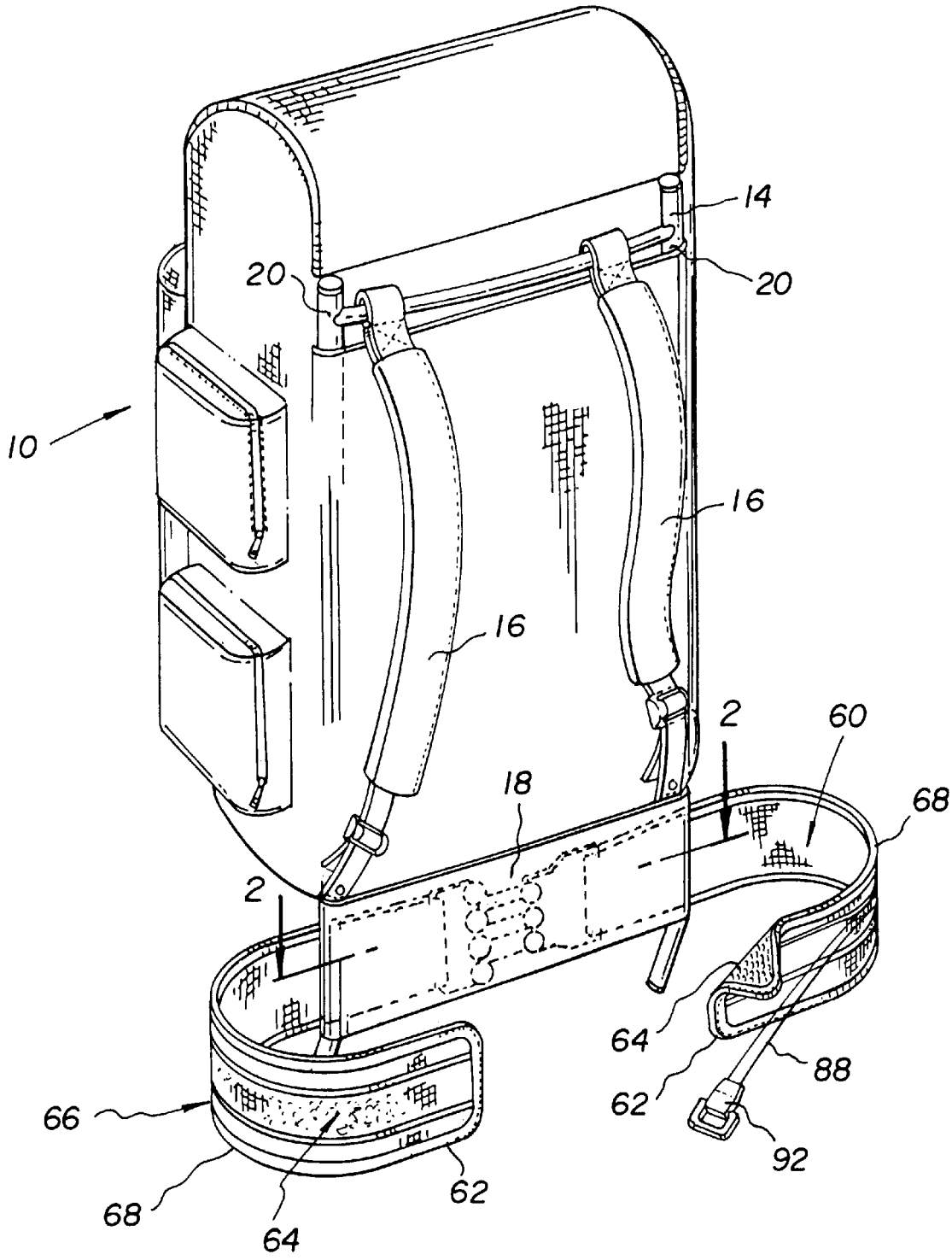
FIG. 1 shows perspective view of a first embodiment of the invention applied to an external frame backpack.
Figure 4:
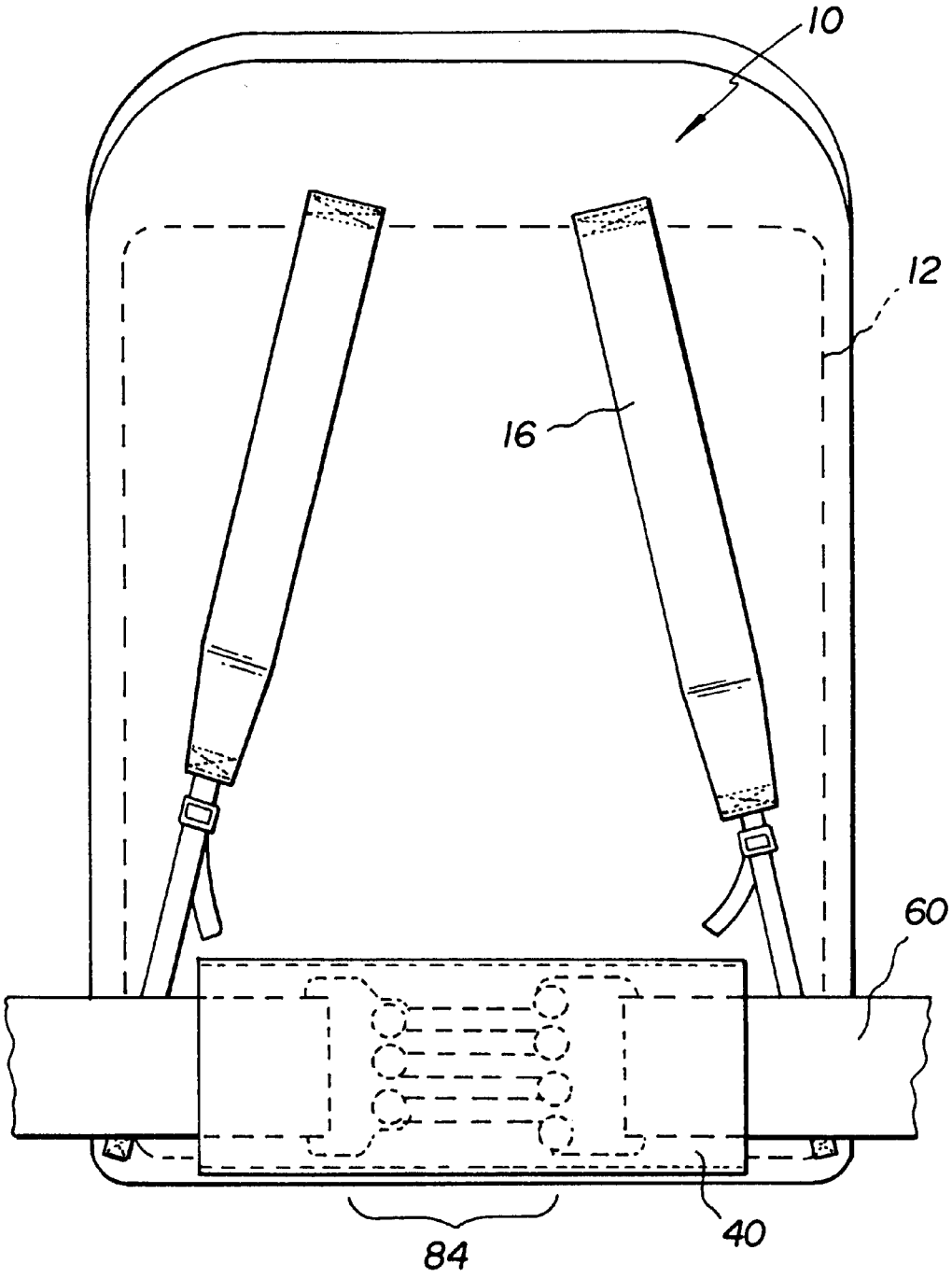
FIG. 4 shows a user-side view of a second embodiment of the invention applied to an internal frame backpack.
Figure 5:
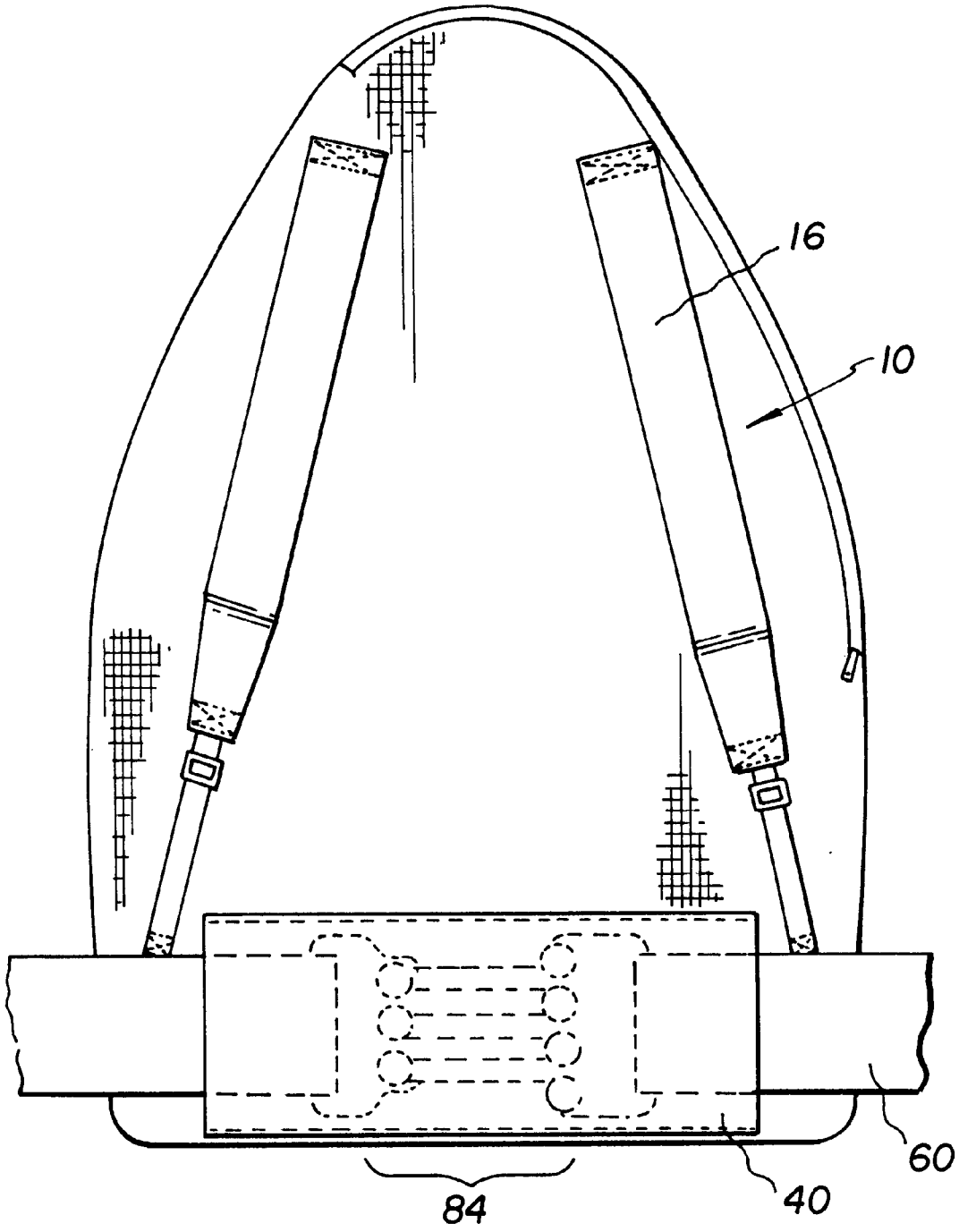
FIG. 5 shows a user-side view of a third embodiment of the invention applied to a daypack, also known as a book bag.
Figure 6:
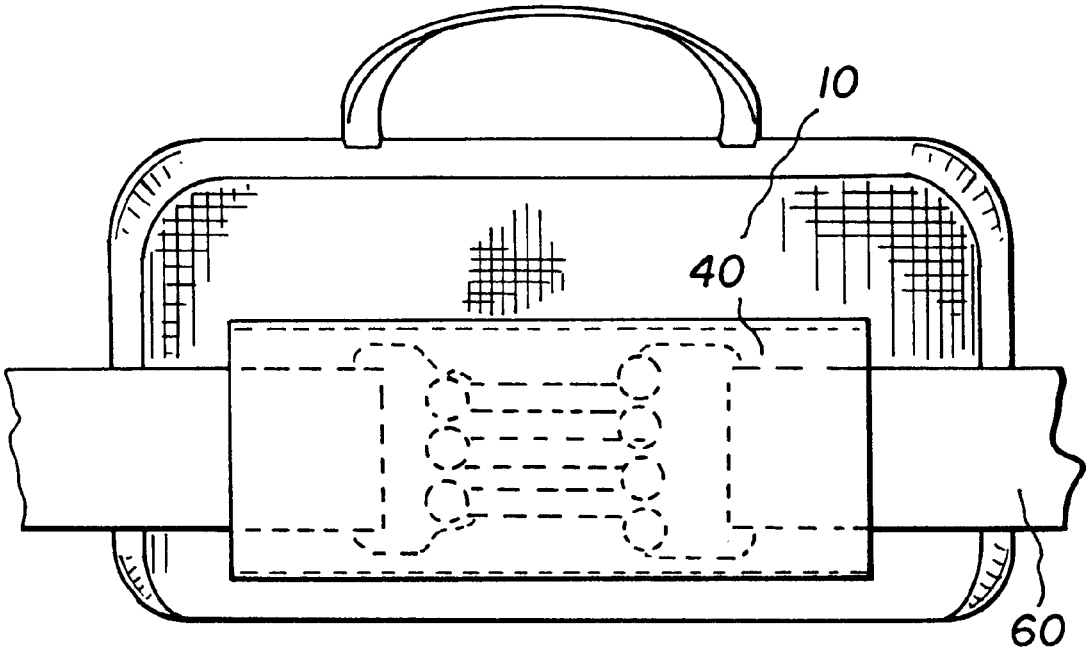
FIG. 6 shows a user-side view of a fourth embodiment of the invention applied to a fannypack.

The invention as shown in FIG. 1, comprises a pack having a body 10 generally made of a fabric material and in one embodiment (FIG. 4) having an interior frame 12 made of lightweight metal, surrounded by fabric material making up the pack. Alternatively, the frame 14 can be external (FIG. 1) and have the pack body 10 attached thereto. In the other embodiments, no frame is provided. Shoulder straps 16 are attached to the top of the metal frame 14 or the pack body 10 itself and at a position approximately halfway down the pack in the case of the internal frame 12 and at a lower portion of the frame in the case of an external frame 14. The bottom of the pack has attached thereto or the metal frame has attached plastic or fabric sleeve 40 approximately 5 inches high and 8 inches wide.

Figure 2:
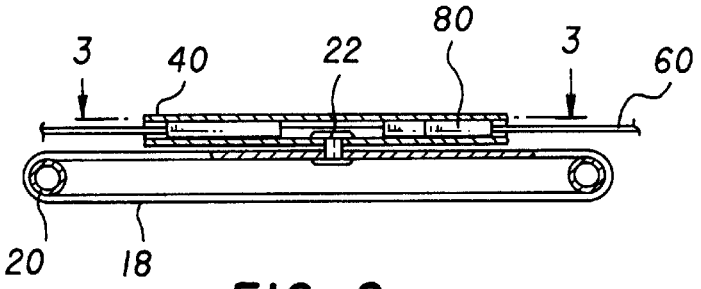
FIG. 2 shows a cross-sectional view of a modification of the first embodiment of the invention with a pivot taken along lines 2—2 in FIG. 1.
Figure 3:
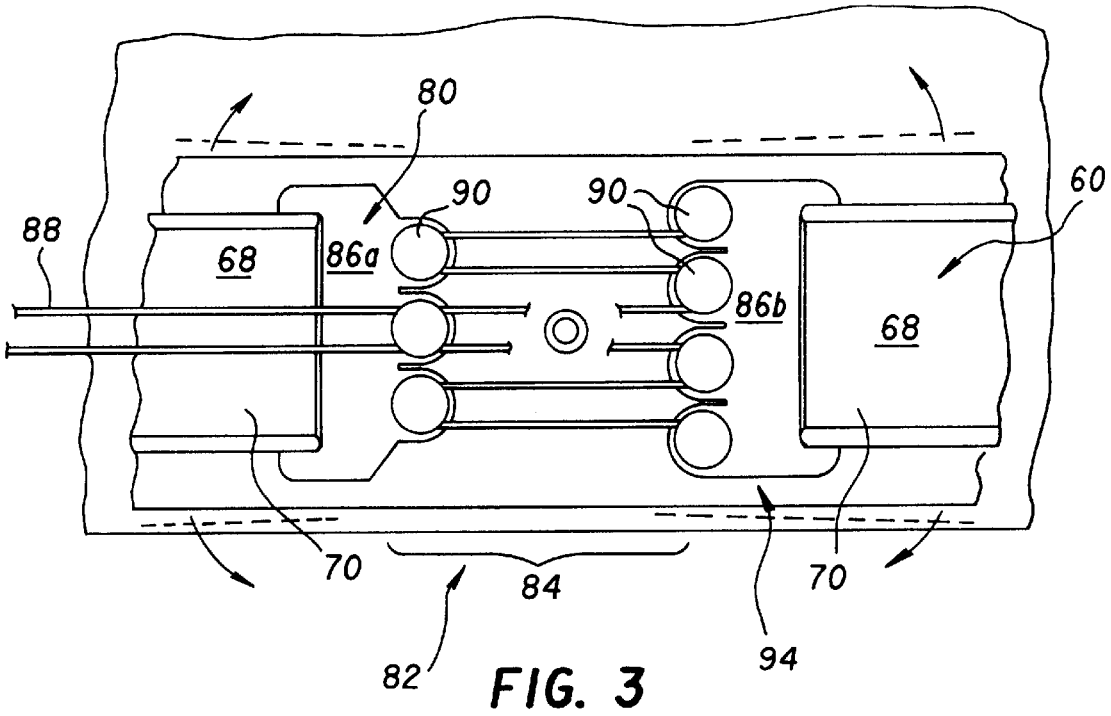
FIG. 3 shows a partial cross-sectional view taken along lines 3—3 of FIG. 2.

The sleeve 40 is essentially a tube for the insertion of a lumbar sacral support (LSS) 60 as described herein below. The sleeve 40 for an internal frame backpack can be attached directly to the fabric of the pack body 10 by sewing or any other conventional manner of attachment. An external frame 14 usually has a fabric band 18 tensioned and extending around the lower portions of the frame members 20. The band 18 is generally resting against a user's back. The sleeve 40 the present invention attaches to the band 18 an external frame pack. Alternative attachments methods can be envisioned. In a further invention, the sleeve 40*n* be attached to the pack body 10 or the frame 14 in a pivotable manner by a pivot pin 22 (FIG. 2). This enables the LSS 60 to rock with the hips in the directions shown by the arrows in FIG. 3, while the user is walking, yet the pack is kept generally stable and level.

The drawing in FIG. 1 displays a common type of external-frame backpack. The mechanical advantage lumbar sacral support LSS 60 connects to the bottom frame of the backpack via the band 18 through a sleeve 40 and is positioned to be placed around the abdominal cavity and located half below and half above L5-S1 spinal vertebra. In one embodiment, it is envisioned to have the attachment point of the sleeve be vertically variable on the pack or frame to enable the precise and correct positioning of the LSS relative to the proper body position and still enable the straps of the pack to be positioned correctly with respect to the shoulders of the user.

The LSS 60 slides inside the sleeve 40 in a manner such that once a switch or other connector is activated, the LSS 60 will stay and be retained inside the sleeve. The LSS 60 becomes the closing mechanism for closing the backpack at the bottom around the hips of the user, approximately next to the pubic bone of the body. The LSS 60 closes in front with a conventional fabric fastening structure, thereby closing the backpack at the bottom of the product. That is, the front ends 62 of the LSS 60 can be attached to itself using conventional means 64 such as hook-and-loop fastening fabric, a zipper, buttons, snaps, buckles, and the like.

The LSS (Lumbar Sacral Support) 60 includes an orthosis type support body 66, in the shape of a wide belt, adapted to be wrapped around the pelvic region of a body of a user, the support body 66 being elongated and formed from a fabric material. Similar structure is shown and disclosed in U.S. Pat. No. 6,213,968, application Ser. No. 09/420,408 filed Oct. 19, 1999, and application Ser. No. 09/760,707 filed Jan. 17, 2001, all of which are incorporated by reference herein in their entirety. The support body 66 is formed in two segments 68. A bionic connecting device 80 which may be detachable is provided at the proximal or inner ends 70 of the elongated support body segments 68 adjacent the backpack body 10 to secure the ends 70 through the sleeve 40 and around the part of the user's body. The connecting device 80 is preferably provided with a means 82 for adjusting the tightness or tension of the support body 66, accomplished preferably by increasing the mechanical advantage of the connecting device 80. Preferably the means 82 for increasing the mechanical advantage of the fastening device is a detachable pulley system 84 which includes a pair of pulley banks 86. A first bank of 86*a* the pulley system is disposed on a first proximal or inner end 70 of the support body 66 and a second pulley bank 86*b* is disposed on a second proximal end 70 of the support body 66. A cable 88 is operatively connected to the two pulley banks 86 such that the first and second banks 86*a*, 86*b* of the pulley system 84 are in juxtaposed relationship. The cable 88 runs through a pulley 90 on each juxtaposed pulley bank in series and in alteration, shortening of the cable 88 pulling the two banks of pulleys 90 and concomitantly the opposed ends 70 of the body 66 together and tightening the device 80 with the aid of mechanical advantage dependent upon the number of pulleys 90 mounted on a base member 94 of the pulley bank 86 on each opposing body end 68. The opposite distal or front ends 62 of the support body segments 68 are provided with a fastening structure 64 as described above at the distal or outer ends 62 of the segments 68 of the support body 66 to detachably secure the ends 62 around a user's torso.

In a preferred embodiment, each set of pulleys 90 comprises two modular banks 86*a*, 86*b* of pulleys 90 which are detachably secured to opposing free ends 70 of the support body segments 68. The cable 88 is provided to connect pulleys 90 in the opposing banks 86 of pulleys in a set in series and in alteration. The ends of each cable 88 preferably may be joined to form an endless cable or are attached to a handle which also achieves the effect of an endless cable. Preferably, the handle 92 also may be removed from the sleeve 40 when and if the modular banks 86 of the pulley set are removed. The handle 92 and the support body segments 68 can each have complementary hook-and-loop fastening materials so that when the cable 88 is pulled to have the LSS 60 at the desired degree of tightness, the handle 92 can be simply and quickly anchored at the desired point by placing the handle 92 on the segment 68.

In an alternative, each set of pulleys 90 can comprises two modular banks of pins which may be made metal and which are detachably secured to opposing free ends of the same support body segment 68. In the same manner as in the preferred embodiment, a cable is provided to connect pins in the opposing banks of pins in a set in series and in alteration. The ends of each cable preferably may be joined to form an endless cable or are attached to a handle which also achieves the effect of an endless cable. Preferably, the handle also may be removed from the body of the device when the modular banks of the pulley set are removed. The metal pins are smooth so that the cable slips around them in much the same manner as a rotatably mounted pulley wheel.

Suitable materials for the segments 68 of the support body 66 include canvas, cotton, polyester, compressed polyester foam, blends of cotton and polyester, nylon, nylon mesh, etc.

The sleeve 40 serves as a tube to contain the set of pulleys or pins and the cable running between them. The sleeve 40 can be fabric or even molded plastic. A hook or other means are provided to prevent the pulley banks from being unintentionally removed from the sleeve. In certain embodiments, it may be desirable to seal the pulley assembly 80 interiorly of the sleeve 40 with only the end of the cable loop 88 and the pull handle 92 extending out of the sleeve. Further, the sleeve 40 can additionally comprise padding. EVA closed cell foam is envisioned as the first layer, with an open cell foam next. The outer layer (closest to the user's body) would be an open basketweave fabric to enhance cooling and comfort.

The number of pulleys 90 provided in each bank 86 of pulleys is determined by such factors as the amount of space provided for pulleys within each bank and the mechanical advantage being sought. The size of the particular bank 86 of pulleys is determined in part by the size of the sleeve 40 and manufacturing considerations. Larger devices allow for concomitantly larger pulley sets and their respective banks of pulleys. The appropriate mechanical advantage is determined with a consideration of the strength of the user, the size or load rating of the backpack and the like. Generally, each pulley system used in the LSS 60 of the invention is constructed with an appropriate number of pulleys to provide a minimum of effort to achieve abdominal compression but not high enough to cause injury by over-tensioning the LSS. Typically, this equates to a mechanical advantage for each pulley system in the range of about 4:1 to about 30:1. For those devices which require less effort to tighten, such as smaller backpacks, a mechanical advantage of about 4:1 to about 8:1 is preferred.

In use, prior to donning the backpack, the user would check the LSS 60 to make sure that it is in a loosened condition. This can be determined by the position of the handle 92 relative to the sleeve 40. The handle position gives a clear indication of the amount of cable 88 strung between the sets 86 of pulleys or pins. The user would don the backpack by positioning the shoulder straps 16 in the usual manner. The support body segments 60 are fastened to each other at the front of the user approximately at the area of the pubic bone. The handle 92 is then pulled to tighten the LSS 60 to efficiently and effectively compress the hips and abdominal cavity by circumvention, thereby at the same time unloading the shoulders and spinal column and transferring and spreading the load of the backpack to pelvic area of the body. The handle 92 is then anchored on the support body segment 68 until the user is ready to doff the backpack.

The concept of the present invention can also be built into the body of the backpack at one or more locations for the purpose of condensing and tightening the load in the pack. The body of the backpack is provided with a tunnel or double ended pocket across the back surface thereof. A bionic tightening mechanism almost identical in structure to the LSS slides inside the double ended pocket or sleeve. The tightening mechanism includes the same structure as the LSS and instead of tightening around the pelvic region of the user, simply tightens and condenses the contents of the backpack. A similar tightening mechanism can be provided attached to a bottom of the backpack or in the cover for a sleeping bag to compress the rolled or folded sleeping bag into a smaller size bundle. The mechanism can also be used to hold other articles as desired, especially those that are compressible.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What we claim is:

1. A pack comprising a pack body, a sleeve attached to the body, and a lumbar sacral support contained in the sleeve and supporting at least a portion of a weight of the pack when secured about a torso of a user and tightened; and a weight of the pack when secured about a torso of a user and tightened: and a frame attached to the body, the frame including frame members with lower portions and a band around the lower portions, the sleeve being attached to the band.

2. A pack according to claim 1, further comprising a pivot pin pivotally attaching the sleeve to the band.

3. A pack and a pack body, a sleeve attached to the body, and a lumbar sacral support contained in the sleeve and supporting at least a portion of a weight of the pack when secured about a torso of a user and tightened; and wherein the lumbar sacral support comprises a support body, the support body including a pair of support body segments, each segment having an inner end portion and a front end with the front ends detachably connectable to each other and; a bionic connecting mechanical advantage device bridging together respective ones of the inner end portions to form a belt having bridged inner end portions, the mechanical advantage device including a drawstring cable operably connected thereto and extending therefrom for causing the mechanical advantage device to move from an expanded state wherein the respective bridged inner end portions are disposed apart from one another to a contracted state wherein the respective bridged inner end portions are drawn towards each other.

4. A pack according to claim 3, wherein the drawstring cable is releasably connectable to either one of the pair of segments.

5. A pack according to claim 3, wherein the drawstring cable includes an endless loop cable and a handle connected to a segment of the endless loop cable while another segment of the endless loop cable is operably connected to the mechanical advantage device.

6. A pack according to claim 5, wherein the handle has a tab portion fabricated from hook-and-loop material and a ring portion connected to the tab portion and fabricated from a stiff material.

7. A pack according to claim 5, wherein the handle is selectably and releasably connected to either one of the two front end portions of the pair of segments.

8. A pack according to claim 3, wherein each one of the pair of segments includes hook-and-loop material attached exteriorly to at least respective ones of the front end portions.

9. A pack according to claim 3, wherein the mechanical advantage device includes two pulley banks, each pulley bank having a base member and a plurality of pulleys rotatably connected to the base member.

10. A pack according to claim 9, wherein respective ones of the pulley banks are detachably connected to the bridged inner end portions of the segments.

11. A pack according to claim 3, wherein the device comprises a pulley system, said pulley system including:

a pair of pulley banks arranged in juxtaposed relationship, a first bank of which is detachably disposed on one inner end portion of one of the segments and a second bank of pulleys detachably disposed on a second inner end portion of the other of the segments; and a cable interconnecting the two pulley banks and running through a pulley on each of the pulley banks in alteration, shortening of the cable pulling the pulley banks together and tightening the lumbar sacral support with the aid of a mechanical advantage dependent upon the number of pulleys mounted on each of the pulley banks.

12. A pack according to claim 11, wherein said cable has two free ends secured to a handle element.

13. A pack according to claim 11, wherein each bank of pulleys includes a base member on which pulleys are mounted, said base member being detachably secured on one inner end portion of one of the segments.

* * * * *